US011402184B2

(12) United States Patent
Braun

(10) Patent No.: US 11,402,184 B2
(45) Date of Patent: Aug. 2, 2022

(54) AMMUNITION CARTRIDGE FOR AN AIR GUN

(71) Applicant: Joel Braun, Princeton, WI (US)

(72) Inventor: Joel Braun, Princeton, WI (US)

( * ) Notice: Subject to any disclaimer, the term of this patent is extended or adjusted under 35 U.S.C. 154(b) by 0 days.

(21) Appl. No.: 17/330,140

(22) Filed: May 25, 2021

(65) Prior Publication Data

US 2021/0381812 A1 Dec. 9, 2021

Related U.S. Application Data

(60) Provisional application No. 63/036,201, filed on Jun. 8, 2020.

(51) Int. Cl.
*F42B 6/10* (2006.01)

(52) U.S. Cl.
CPC ..... *F42B 6/10* (2013.01)

(58) Field of Classification Search
CPC ..... F42B 6/10; F42B 6/00; F42B 6/07–12
USPC ..... 124/41.1, 42, 43
See application file for complete search history.

(56) References Cited

U.S. PATENT DOCUMENTS 838,511 A * 12/1906 Saunders ..... F42B 12/78 102/514
2,098,068 A * 11/1937 Skinner ..... F42B 8/06 102/444
2,144,232 A * 1/1939 Spengler ..... F42B 7/12 102/462
3,596,600 A * 8/1971 Himmelsbach, Jr. ..... F42B 7/12 102/462
3,724,376 A * 4/1973 Kordas ..... F42B 7/06 102/451
4,063,486 A * 12/1977 Ashley ..... F41A 1/04 102/440
4,686,905 A * 8/1987 Szabo ..... F42B 12/50 42/76.01
4,697,523 A * 10/1987 Saxby ..... F41B 11/62 102/440
5,359,937 A * 11/1994 Dittrich ..... F42B 14/064 102/444
5,492,063 A * 2/1996 Dittrich ..... F42B 5/02 102/444
5,677,505 A * 10/1997 Dittrich ..... F42B 5/02 102/444

(Continued)

FOREIGN PATENT DOCUMENTS

EP 2573503 A1 * 3/2013 ..... F42B 6/10
GB 2307033 A * 5/1997 ..... F42B 6/10
WO WO-9855823 A1 * 12/1998 ..... F42B 12/40

*Primary Examiner* — Jonathan C Weber
(74) *Attorney, Agent, or Firm* — Eric B. Fugett; Mark A. Pitchford; Pitchford Fugett, PLLC

(57) ABSTRACT

An ammunition cartridge for an air gun includes a housing, a partition, a cap, at least one projectile, and at least one gas flow aperture. The housing defines an interior space. The housing has a rear portion and a forward portion. The partition is disposed in the interior space and engaged with the rear portion. The cap is releasably engaged with the forward portion. The at least one projectile is received in the interior space between the partition and the cap. The at least one gas flow aperture extends through the partition and provides a fluid flow path through which a pressurized gas provided by the air gun enters and pressurizes the interior space to propel the cartridge through a barrel bore of the air gun.

17 Claims, 6 Drawing Sheets

(56) References Cited

U.S. PATENT DOCUMENTS

| | | | | |
|---|---|---|---|---|
| 7,059,316 | B1 * | 6/2006 | Tseng | F41B 11/00 102/440 |
| 2019/0078855 | A1 * | 3/2019 | Berger | F41B 11/60 |

* cited by examiner

AMMUNITION CARTRIDGE FOR AN AIR GUN

CROSS-REFERENCE TO RELATED APPLICATIONS

This non-provisional patent application claims priority to U.S. Provisional Patent Application Ser. No. 63/036,201, filed Jun. 8, 2020, and titled "AMMUNITION CARTRIDGE FOR AN AIR GUN," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The invention relates generally to air guns, and more specifically to ammunition cartridges for air guns.

Many countries, states, and municipalities around the world restrict or outright prohibit the ownership and use by civilians of traditional firearms. By contrast, air guns are comparatively unregulated, particularly in the United States. Indeed, air guns are widely owned and used by civilians throughout the country in a variety of lawful activities, including hunting, recreational target shooting, and airsoft sports. Air guns are traditionally designed to fire a single monolithic projectile using either a smooth bore or, as is more often the case today, a rifled barrel. Such projectiles are typically either spherical (commonly known as "BBs") or non-spherical (commonly known as "pellets") and are formed from a metallic or polymeric material. Both types of projectiles are used in different calibers for hunting small and large game animals. However, they are generally unsuitable for use against fast moving and flying targets, such as game birds, due to the inherent difficulty of hitting and dispatching a distant moving target with a single projectile.

A shotshell is a type of ammunition cartridge that contains multiple (typically spherical) projectiles known as "shot." When discharged or fired, the shot disperses (i.e., spreads) in a widening conical pattern outwardly from the muzzle of the gun. This makes shotshells the preferred ammunition type for hunting game birds. Despite this, very few shotshells for air guns are presently commercially available. Moreover, currently available air gun shotshells generally only function with a single corresponding air gun and must be hand loaded into the chamber of the barrel. Currently available air gun shotshells also tend to rely on overly light shot payloads, have low energy, and/or break apart upon exiting the muzzle of the gun, all of which each of which can result in poor accuracy and unreliable lethality.

Accordingly, what is needed are improvements in ammunition cartridges for air guns.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide an ammunition cartridge for an air gun in the form of a universal shotshell that is configured to function with any pre-existing air gun of suitably matching caliber. The cartridges disclosed herein expand the operational capabilities of existing air guns by providing a robust air gun shotshell which provides the accuracy, consistency, velocity, and lethality of a traditional shotgun shell, but which lacks some or all of the deficiencies of currently available air gun shotshells.

Accordingly, the present invention provides an ammunition cartridge for an air gun comprising a cylindrical housing or shell casing defining an interior space and having a rear portion and a forward portion; a partition or base member disposed in the interior space and engaged with the rear portion of the housing; a cap releasably engaged with the forward portion of the housing; at least one projectile received in the interior space between the partition and the cap; and at least one gas flow aperture extending through the partition. The cap is configured to disengage from the forward end of the housing and release the at least one projectile from the interior space when the cartridge exits the muzzle of an air gun after a volume of pressurized gas provided by the air gun is flowed through the at least one gas flow aperture into the interior space.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

This description and appended claims include the words "below", "above", "over," "under," "side", "top", "bottom", "upper", "lower", "when", "vertical", "horizontal", "upright", etc. to provide an orientation of embodiments of the invention to allow for proper description of example embodiments. The foregoing positional terms refer to the assembly when in the orientation shown in FIG. 1. A person of skill in the art will recognize that the assembly can assume different orientations when in use.

Figure 1:
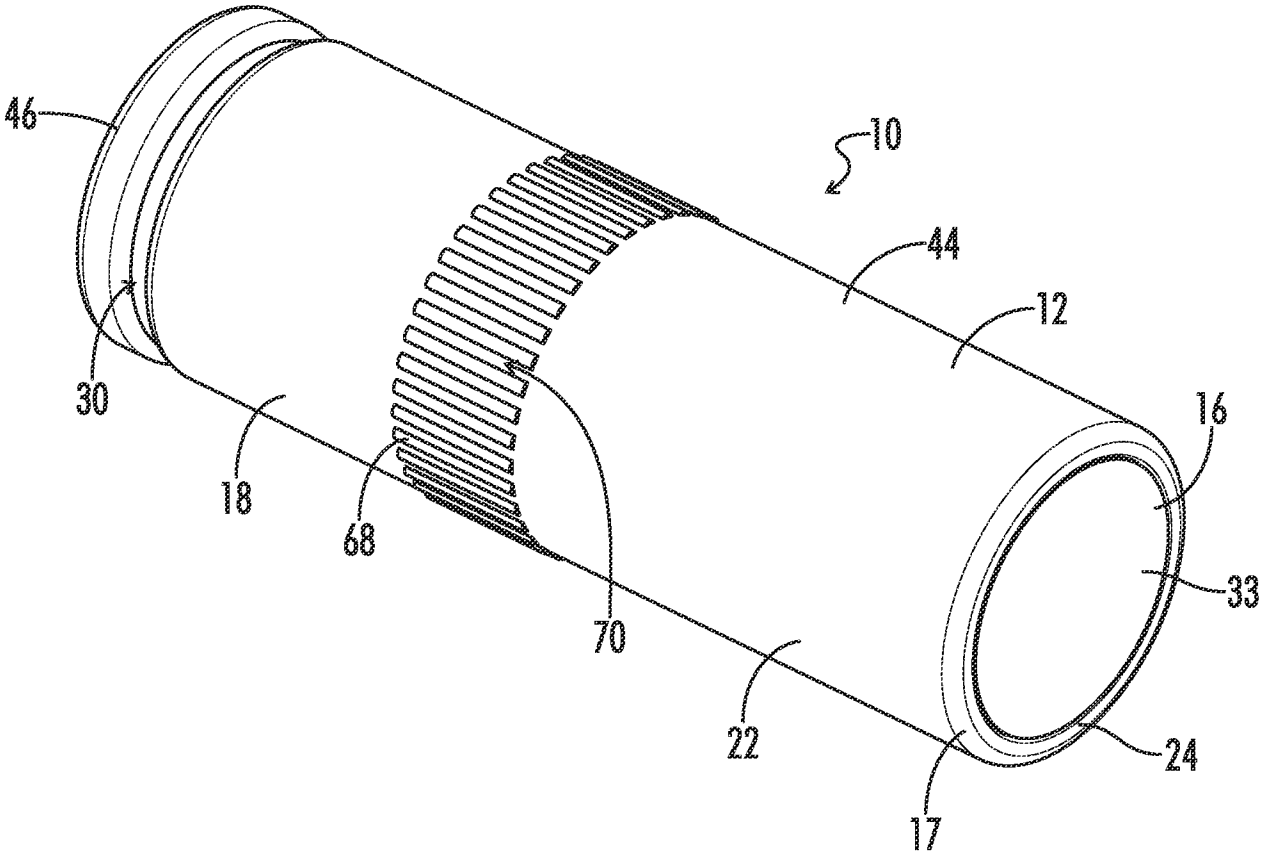
FIG. 1 is a front isometric view of an embodiment of an ammunition cartridge for an air gun constructed in accordance with the present invention.

Similarly, an "upright" position as described herein is considered to be the position of the apparatus or assembly components while in proper operation or in a natural resting position as described and shown herein, for example, in FIG. 1. It is also contemplated that embodiments of the invention may be in orientations other than upright without departing from the spirit and scope of the invention as set forth in the appended claims. Further, the terms "above", "below", "over", and "under" mean "having an elevation or vertical height greater or lesser than" and are not intended to imply that one object or component is directly over or under another object or component, unless specifically indicated to the contrary. The term "when" is used to specify orientation for relative positions of components, not as a temporal limitation of the claims or apparatus described and claimed herein unless otherwise specified.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring generally to FIGS. 1 through 9, there is shown an ammunition cartridge 10 for an air gun 90 constructed according to an embodiment of the present invention. The ammunition cartridge 10 includes a housing 12 (also known as a "casing"), a plurality of projectiles 14, and a cap 16. The housing 12 is a substantially hollow cylindrical or tubular body which defines a longitudinal axis 15. The projectiles 14 are contained within the housing 12. The cap 16 is received in and releasably engaged with an end of the housing 12. The cap 16 retains the projectiles inside the housing 12 until at least a portion of the cartridge 10 is propelled out of a muzzle 48 of an air gun 90 by a pressurized gas provided by the air gun 90.

The housing 12 includes a rear end portion 18 having a rear end 46, and a forward end portion 22 having an open forward end 17 opposite the rear end 46. The rear end 46 includes a rim 20. The open forward end 17 includes a lip 24. The housing 12 defines an interior space 25 that functions as a shot chamber in which the projectiles 14 are housed or contained. A partition 26 is disposed in the rear portion 18 of the housing 12. The partition 26 can be integrally formed with the housing 12 or formed separately from and subsequently secured to the housing 12. As such, each of the housing 12 and the partition 26 can be formed from any resilient or rigid and lightweight, durable material. Suitable materials include but are not limited to polymeric materials and metallic materials, including various plastics and metals currently used in the production of cartridges for traditional firearms and air guns.

A plurality of gas flow apertures 28 or through holes are defined in and extend completely through the partition 26. Each aperture 28 has a diameter. In some embodiments, each aperture has the same diameter. In other embodiments, some apertures can have different diameters. One gas flow aperture 28 is defined through a geometric center 29 located in a central portion 42 of the partition 26. The remaining gas flow apertures 28 are defined through a peripheral portion 43 of the partition 26 which surrounds the central portion 42. More specifically, the remaining gas flow apertures 28 are disposed radially about and equidistantly spaced from the central gas flow aperture 28. Thus, the remaining gas flow apertures 28 are peripheral to the central gas flow aperture 28. The one central gas flow aperture 28 is concentric with the longitudinal axis 15, while the peripheral gas flow apertures 28 extend through the partition 26 parallel to the longitudinal axis 15.

Figure 5:
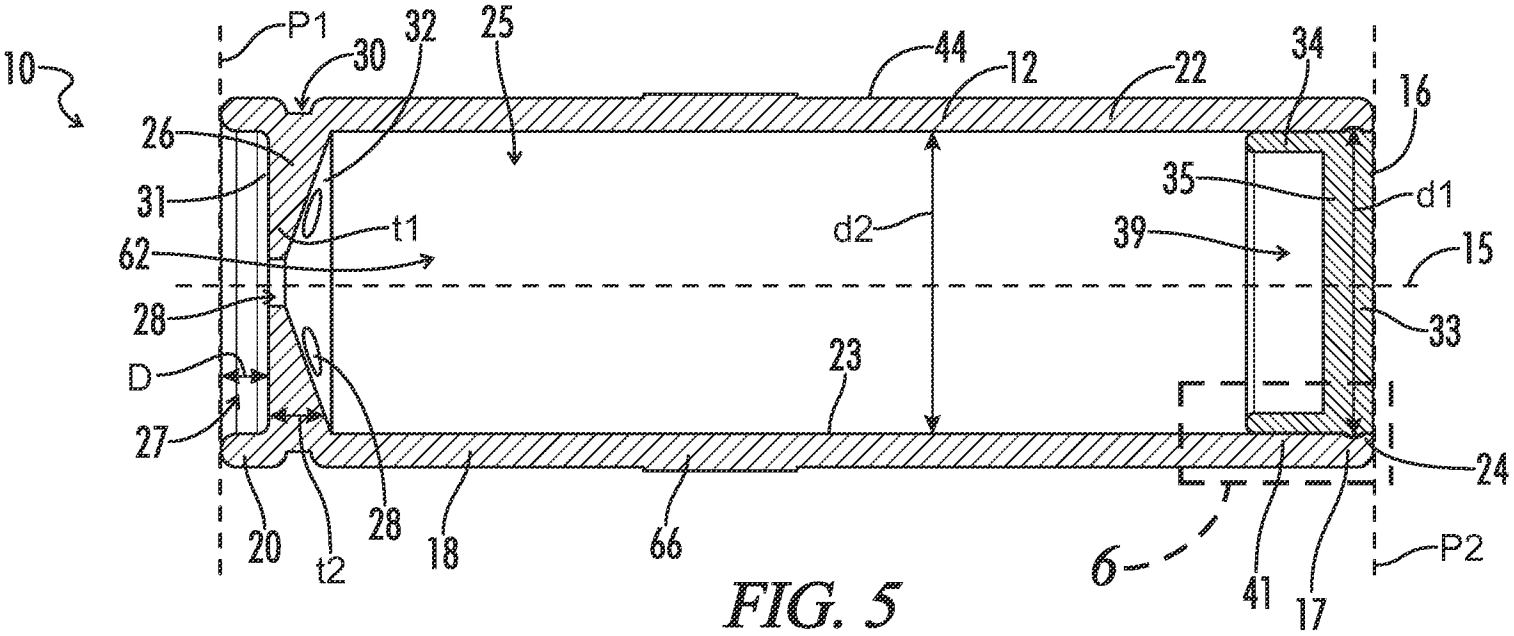
FIG. 5 is a sectional view taken along the longitudinal axis of the cartridge of FIG. 4 indicated by line 5-5. For clarity, the cartridge is shown without any projectiles contained within the interior space.
Figure 7:
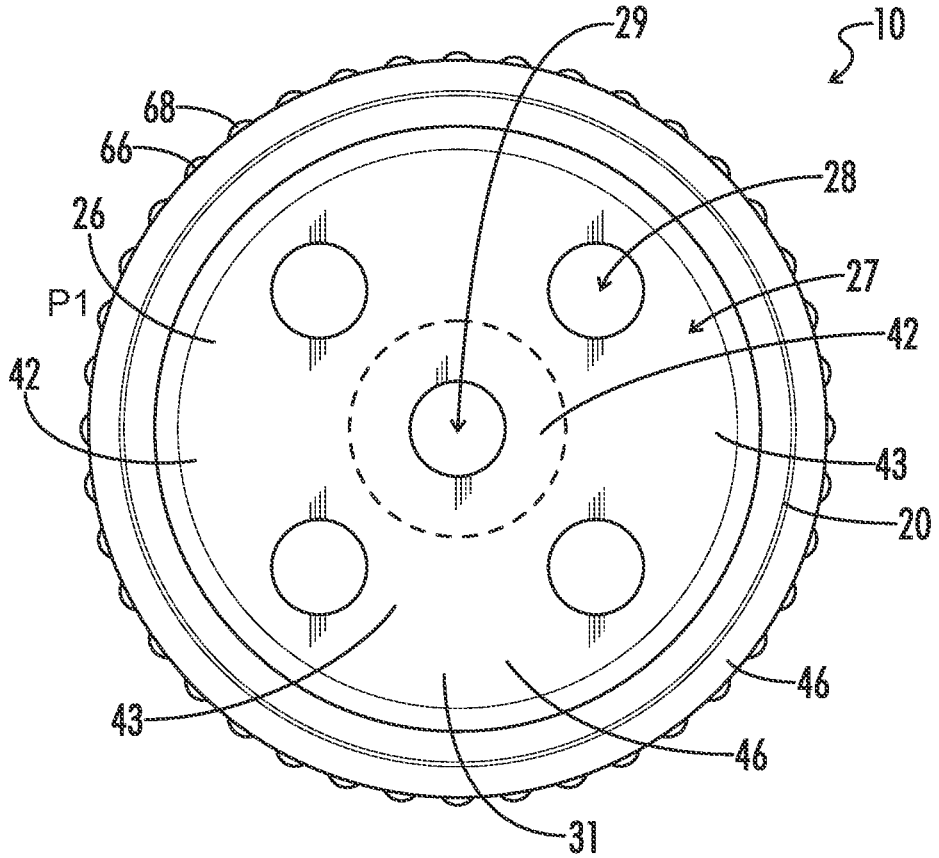
FIG. 7 is an elevational rear view of the cartridge of FIG. 1.

Referring now to FIGS. 5 and 7, the central portion 42 of the partition 26 has a first thickness $t_1$, while the peripheral portion 43 of the partition 26 has a second thickness $t_2$. The second thickness $t_2$ is greater than the first thickness $t_1$. In some embodiments, the second thickness $t_2$ increases in a direction extending radially outward from the central portion 42. In some embodiments, the first thickness $t_1$ can be equal to a length of the central gas flow aperture 28.

The partition 26 includes a rear surface 31. The rear surface 31 can be substantially planar (i.e., flat) and can be recessed a distance D from a plane P1 defined by the rearwardmost end of the rim 20 of the rear portion 18 of the housing 12. A forward surface 32 of the partition 26 is opposite the rear surface 31 and faces the interior space 25. In contrast to the rear surface 31, the forward surface 32 of the partition 26 is non-planar. In some embodiments, the forward surface 32 of the partition can be concave, as best shown in FIG. 5. In other words, the forward surface 32 can be angled, curved, and/or sloped. The plurality of gas flow apertures 28 extends from the rear surface 31 to the non-planar forward surface 32. The non-planar forward surface 32 with gas flow apertures extending therethrough facilitates even distribution of pressurized gasses generated by the air gun 90 through the gas flow apertures 28 and into the interior space 25. In this way, the partition 26 can function as a valve through which pressurized gasses from the air gun 90 flow during discharge of the air gun and use of the cartridge 10, as well as a floor or base member of the interior space 25 on which the projectiles 14 can be loaded during manufacture and assembly of the cartridge 10.

It should be understood that the plurality of gas flow apertures 28 formed in a housing 12 for an ammunition cartridge 10 constructed in accordance with the present invention can differ in number and can be arranged in a different pattern from that shown in FIG. 7 and still remain within the scope of the present invention. However, the use in a cartridge of five gas flow apertures 28 with a uniform diameter arranged in the pattern shown in FIG. 7 has been found to consistently and reliably deliver sufficient energy to the projectiles 14 to propel the projectiles 14 out of the muzzle of an air gun at a velocity suitable for game hunting when such cartridge is fired from currently commercially available air guns, including precharged pneumatic ("PCP") air guns.

Figure 2:
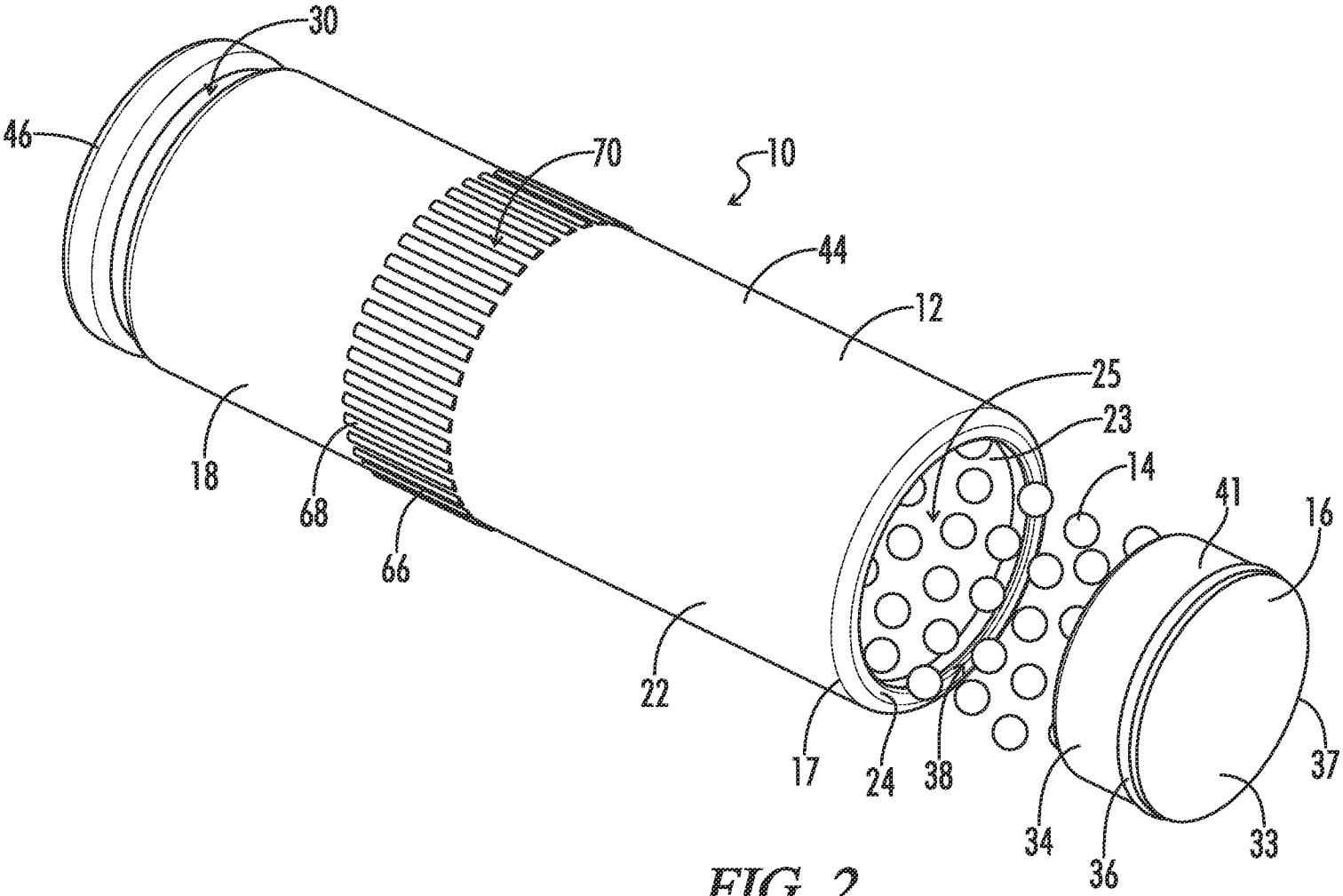
FIG. 2. is an exploded front isometric view of the cartridge of FIG. 1.
Figure 3:
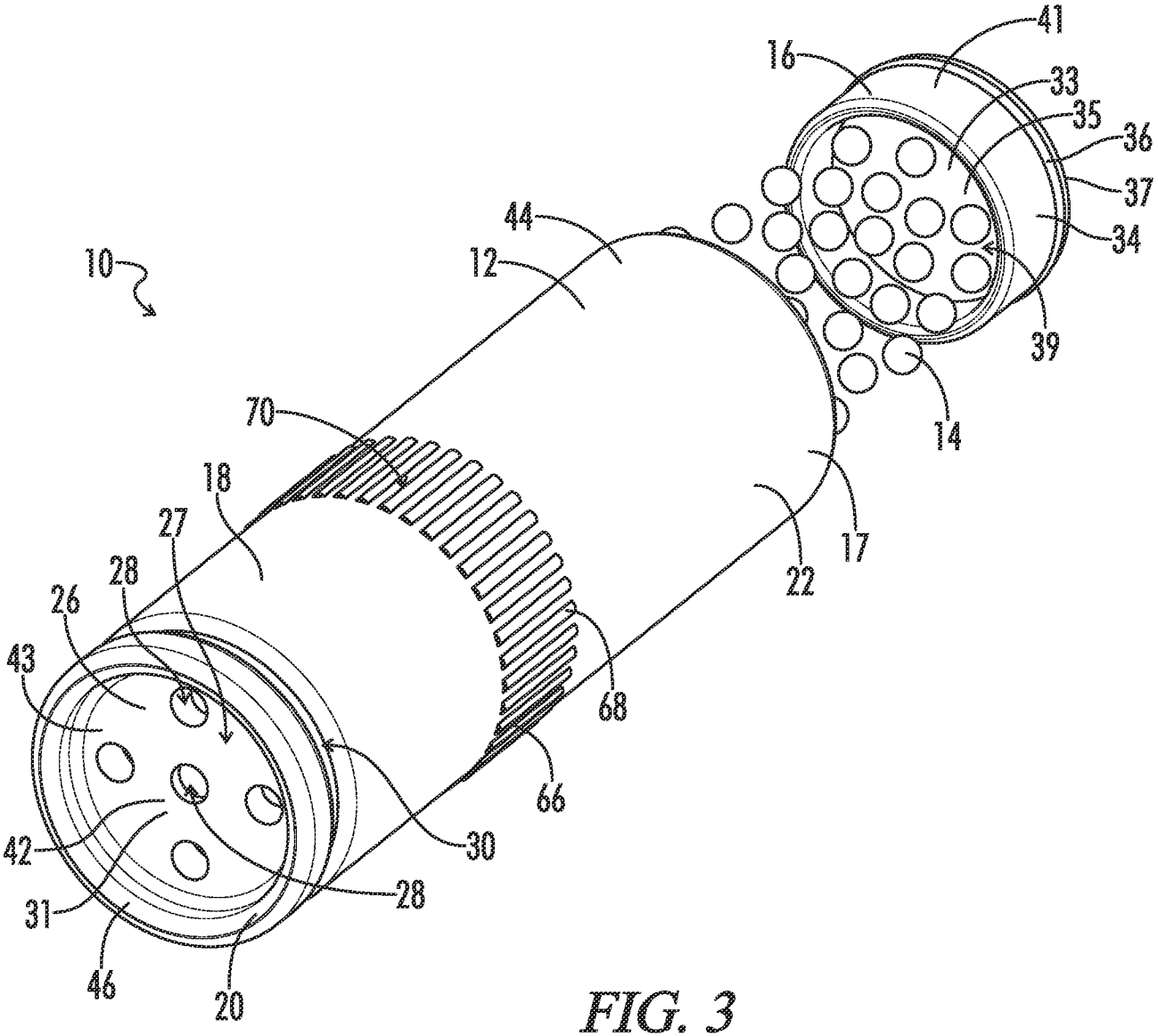
FIG. 3 is an exploded rear isometric view of the cartridge of FIG. 1.

Referring now to FIGS. 2-3, the cap 16 includes a solid (i.e., non-porous) disc portion 33 and an annular skirt 34. The disc portion 33 includes an inner surface 35 and a circumferential edge 37. The inner surface 35 can be substantially planar. However, in other embodiments, the inner surface 35 can be concave. The skirt 34 extends rearwardly away from the inner surface 35 at the circumferential edge 37. In this way, the skirt 34 forms against the inner surface 35 a hollow space 39 or seat in which a portion of the plurality of projectiles 14 can rest when the cartridge 10 is assembled as disclosed herein.

The cap 16 further includes an annular ridge 36. The ridge 36 is formed on and protrudes radially outward from an outer circumferential surface 41 of the skirt 34. The ridge 36 is relatively narrow and is located proximate to the disc portion 33 of the cap 16. In some embodiments, the ridge 36 can be spaced rearwardly a distance from the disc portion 33 of the cap 16, while in other embodiments the ridge 36 can be adjacent the disc portion 33 of the cap 16. The cap 16 can be formed from any suitably lightweight and durable polymeric material or blend of materials which will not tear, rip or otherwise break apart upon the application to the cap 16 of pressurized gasses resulting from discharge of a large caliber PCP air gun 90.

Figure 6:
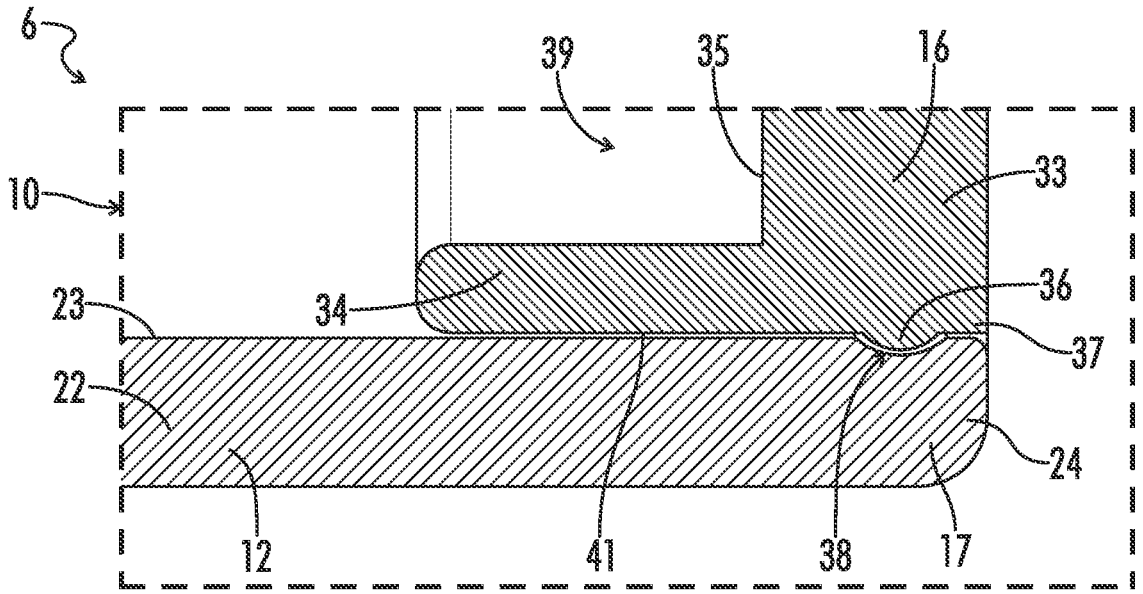
FIG. 6 is an enlarged detail view of the cartridge of FIG. 5 at location 6.

As best shown in FIGS. 5 and 6, an annular groove 38 is formed in an inner circumferential surface 23 of the forward portion 22 of the cartridge housing 12. The groove 38 is spaced rearwardly a distance from a plane P2 defined by the forwardmost edge of the lip 24. The groove 38 defines a first inner diameter $d_1$ that is greater than a second inner diameter $d_2$ defined by the inner circumferential surface 23 of the cartridge housing 12. The groove 38 is complementary to and sized to matingly engage the annular ridge 36 protruding from the skirt 34 of the cap 16 when the cap 16 is received in the forward end 17 or mouth of the cartridge 10. In this way, the groove 38 forms a friction fit with the ridge 36 of the cap 16 and retains the cap 16 in the forward portion 22 of the cartridge 10. This enables the cap 16 to securely retain the projectiles 14 in the interior space 25 until the air gun is discharged and cap 16 is subsequently ejected from the housing 12 as described below. Additionally, the projectiles 14 received or packed within the interior space 25 and the hollow space 39 of the cap 16 apply pressure radially outward on the inner surface of the skirt 34. This pressure causes the skirt 34 to flex and thus bias the ridge 36 into the groove 38, thereby maintaining the engagement between the ridge 36 and groove 38 while cartridge is present within the chamber 92 or bore 56 of the air gun 90.

Figure 4:
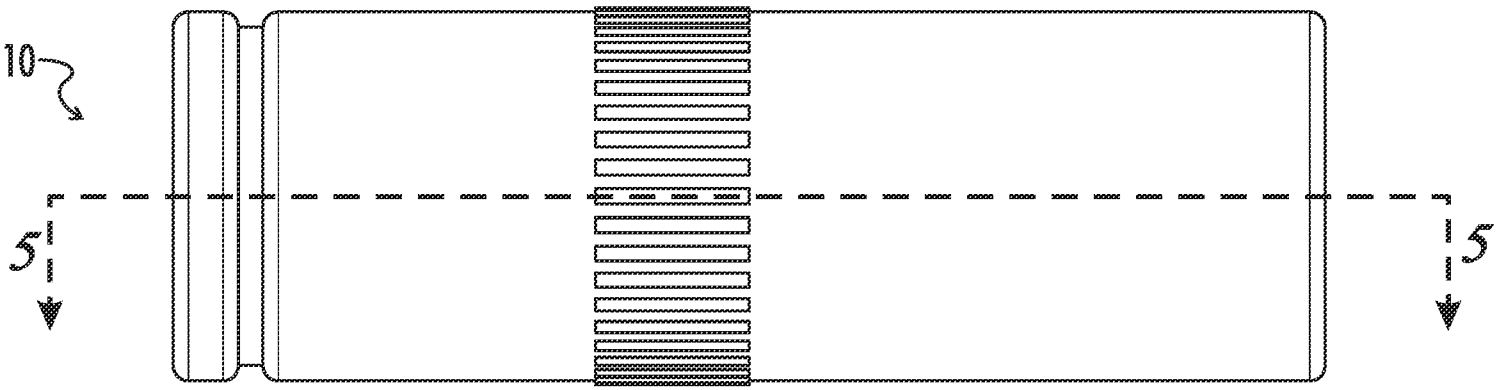
FIG. 4 is a side elevational view of the cartridge of FIG. 1.
Figure 8:
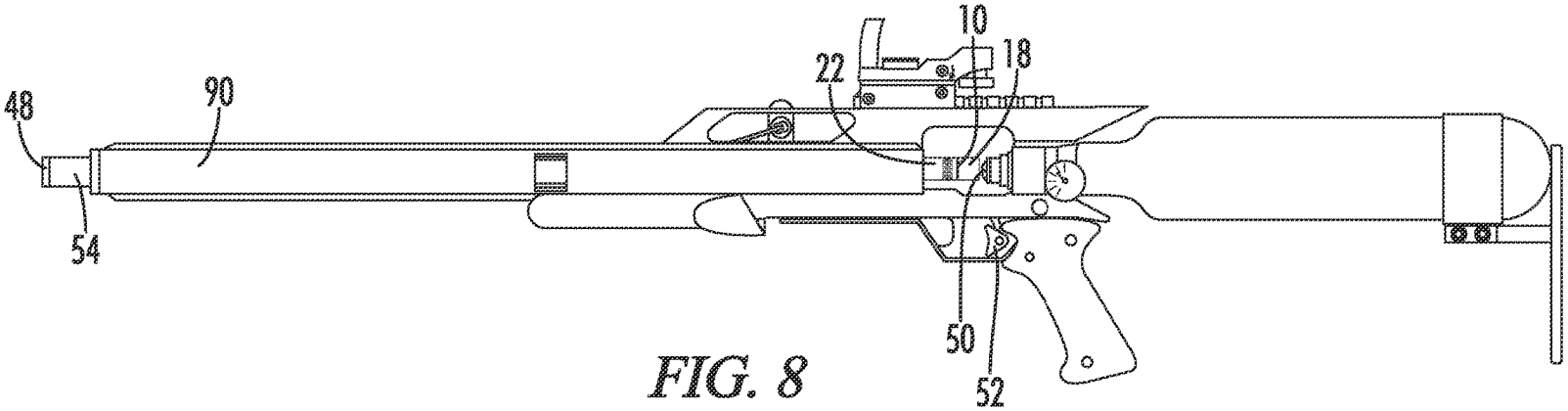
FIG. 8 is a perspective view of the cartridge of FIG. 1 positioned for loading into the chamber of an air gun.
Figure 9:
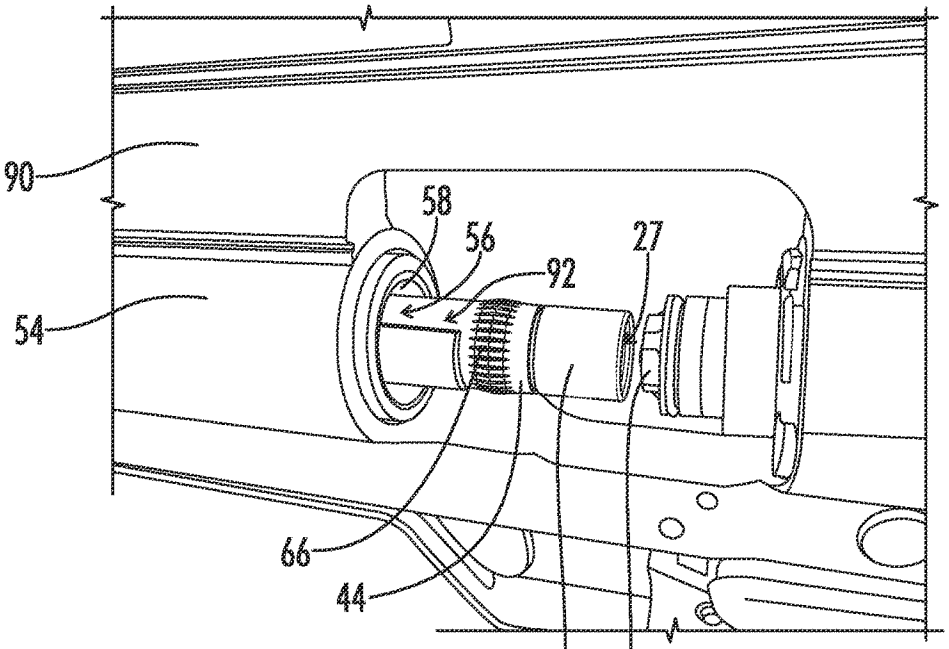
FIG. 9 is an enlarged view of the objects of FIG. 8 at location 9.

Turning now to FIGS. 2-4, a channel 30 is defined in and extends around an exterior circumferential surface 44 of the housing 12 between a rear end 46 and the forward end 17 of the housing 12. The channel 30 is located within a plane which extends substantially normal to the longitudinal axis 15 of the cartridge 10. The channel 30 is preferably positioned closer to the rim 20 at the rear end 46 of the rear portion 18 of the housing 12 than the lip 24 at the forward end 17 of the forward portion 22 of the housing 12. This causes the rear portion 18 of the cartridge 10 to resemble the case head of a traditional shotgun shell for a firearm. As such, the channel 30 provides both a tactile and a visual reference which aids a user in properly orienting the cartridge 10 for loading into a chamber 92 of the air gun 90, as shown in FIGS. 8 and 9. It is to be understood that, although the channel 30 is depicted as formed within a portion of the housing 12 around the partition 26 and proximate the rear end 46, in other embodiments, the channel 30 can be spaced further away from the rear end 46 of the housing 12. Put differently, in some embodiments, the channel 30 can be formed at any location along the length of the housing 12.

In use, the cartridge 10 is loaded into the chamber 92 of the air gun 90 with the forward portion 22 pointing forward as shown in FIG. 9. More specifically, the forward portion 22 of the housing 12 is closer than the rear portion 18 of the housing 12 to a muzzle 48 (shown in FIG. 8) of the air gun 90 when the cartridge 10 is received in the chamber 92 of the air gun 90. Further, the rear portion 18 of the housing 12 is closer than the forward portion 22 of the housing 12 to a gas outlet 50 (shown in FIG. 9) of the air gun when the cartridge 10 is received in the chamber 92. With reference to FIG. 8, actuation of a trigger 52 of the air gun 90 causes the air gun 90 to release a volume of pressurized gas or air via the gas outlet 50 of the air gun 90. The pressurized gas fills a recess 27 defined by the rear portion 18 of the housing 12 (see FIGS. 3 and 5) and flows through the gas flow apertures 28 of the partition 26 to fill both the interior space 25 around the projectiles 14 (see FIGS. 2 and 5) as well as the hollow space 39 of the cap 16 (see FIGS. 3 and 5). In other words, the recess 27 adjacent the rear surface 31 of the partition 26 is in fluid communication with the interior space 25 through the plurality of gas flow apertures 28, as best shown in FIG. 5.

It should be appreciated that because the rear surface 31 is recessed from the rim 20, the pressurized gas may collect and build evenly behind the partition 26. The pressurized gas simultaneously pushes against the rear surface 31 of the partition 26, the projectiles 14, and the cap 16, to propel the entire cartridge 10 through the bore 56 and out the muzzle 48 of a barrel 54 of the air gun 90 (shown in FIG. 8). Thus, the gas flow apertures 28 provide a fluid flow path 62 (shown in FIG. 5) through which the pressurized gas enters the interior space 25 from outside the cartridge 10 to pressurize the interior space 25 of the cartridge relative to an atmospheric pressure of air surrounding the air gun 90 (shown in FIGS. 8 and 9). In this way, the housing 12 of the cartridge 10 functions as both a casing or hull, as well as a wad, from a traditional shotgun shell.

With reference to FIG. 9, upon the application of pressurized gas to the cartridge 10, a portion of the cartridge 10 can obturate to fill a bore 56 defined through the barrel 54 of the air gun 90. Consequently, the exterior circumferential surface 44 of the cartridge housing 12 can contact at least a portion of an interior surface 58 of the bore 56 while the cartridge 10 is traveling through the bore 56. This prevents the pressurized gas from deforming either the cap 16 or the forward portion 22 of the cartridge housing 12 enough to release or eject the cap 16 from the housing 12 before the cartridge 10 has exited the barrel 54 of the air gun 90. In this way, the pressurized gas is prevented from blowing the cap 16 out of the forward end 17 of the cartridge 10 until at least the forward end portion 22 of the cartridge 10 has exited the muzzle 48. Once the cartridge 10 has begun to exit the muzzle 48, the pressurized gas filling the interior space 25 and propelling the projectiles 14 causes the cap 16 (and in some embodiments, the housing 12) to flex, which in turn causes the ridge 36 of the cap 16 to disengage from the groove 38 in the forward end 17 of the housing 12. As the cap 16 disengages from the forward end 17 of the housing 12, the pressurized gas pushes the projectiles 14 and the cap 16 out of the interior space 25 of the housing 12 and toward a target. In some embodiments, the housing 12 can impact the target shortly after the projectiles 14. In other embodiments, the housing 12 can impact the target with one or more of the projectiles 14. It should also be understood that in some embodiments, the cap 16 can be prevented from releasing or disengaging from the forward end 17 of the housing 12 until the entire cartridge 10 has exited the muzzle 48 of the air gun 90. Likewise, in alternate embodiments, the cap 16 can be releasably engaged with the forward end 17 of the housing 12 using engaging means other than the mating ridge 36 and groove 38 described above.

It is to be understood that the shape, size, and quantity of components used to form the disclosed cartridges 10 can vary from those exemplified herein and remain within the scope of the invention. For example, the type, shape, size and number of projectiles 14 can all vary and remain within the scope of the invention. Indeed, although the cartridge 10 is depicted in FIGS. 2-3 as including a plurality of generally spherical steel projectiles 14 having a uniform diameter contained within the interior space 25, a fewer or greater number of projectiles having the same or different diameters, or a completely different shape, can instead be used. It is specifically contemplated that certain embodiments of the cartridge 10 disclosed herein can contain a single monolithic projectile, such as a traditional shotgun slug round formed from lead or steel. Similarly, some embodiments of the cartridge 10 can contain bird shot, while other embodiments of the of the cartridge 10 can contain buck shot. In additional embodiments, a projectile 14 suitable for use in a cartridge 10 of the present invention can be, without limitation, a sabot slug, a bolo round, a piranha round, a non-lethal bean bag round, or the like. It is preferred, but not essential, that each projectile 14 used in a cartridge 10 of the present invention should have a diameter that is greater than the diameter of each gas flow aperture 28 so as to prevent undesirable escape of a projectile 14 from the interior space 25 through one or more of the plurality of gas flow apertures 28.

It is also to be understood that the length and diameter of the housing 12 can also be varied to accommodate air guns of different calibers and different shooting applications. For example, the housing 12 can be dimensioned in .30 caliber, .50 caliber, or .55 caliber, among others. Additionally, the housing can be lengthened or shortened to provide "long" or "short" (e.g., .55 caliber "chub") rounds suited to specific hunting applications. Cartridges having a relatively reduced length carry a coordinately reduced projectile payload.

Cartridges 10 constructed in accordance with the present invention are designed to function in any commercially available air gun, including for example such large caliber air guns as the UMAREX® .50 caliber "Hammer" air rifle, the AIRFORCE® .50 caliber "Texan" air rifle, and the SENECA® "Wing Shot".50 caliber air shotgun, among others.

In order to enable the cartridge 10 to more easily function with autoloading air guns, including those which use linear and rotary magazines, the exterior circumferential surface 44 along the rear portion 18 of the housing 12, including the rim 20 thereof, lacks any radially extending rim or ridge such as is typically present on the case head of traditional shotgun shells.

In some embodiments, the exterior circumferential surface 44 of the cartridge housing 12 can include a band of knurling 66 or other textural feature. The band of knurling 66 can help the cartridge housing 12 sealingly engage the bore 56 of the air gun 90, which is advantageous to overcoming known variations in the internal diameter of air gun barrels. The band of knurling 66 can be formed of a plurality of parallel, longitudinally extending ridges 68 protruding radially outwardly from the exterior circumferential surface 44 and/or a plurality of parallel, longitudinally extending grooves 70 defined in the exterior circumferential surface 44. However, in other embodiments, the band of knurling 66 can be a band of one or more different textural features.

The performance of cartridges disclosed herein can vary depending on the air gun, barrel type, air pressure, and projectile(s) used. For example, the cartridges 10 disclosed herein are reliably functional with the native rifled barrels of commercially available air guns. However, the inventor has discovered that it can be desirable to replace the native rifled barrel of a commercially available large caliber air gun with an otherwise identical barrel having a smooth bore. Alternatively, it can be desirable to replace the native barrel of a commercially available air gun with an otherwise identical barrel having a smooth bore of a larger caliber. For example, depending on a user's intended application, it can be desirable to replace a .50 caliber rifled barrel with a .55 caliber smooth bore barrel that is otherwise identical to the native .50 caliber rifled barrel of an air rifle. Use of a barrel having a smooth and/or larger caliber bore can desirably provide increased projectile velocity as compared to native rifled barrels of lesser caliber.

The inventor has also discovered that it can be advantageous to attach a traditional shotgun barrel choke to an air gun barrel from which cartridges disclosed herein are intended to be fired. A choke constricts the interior diameter of a barrel at the muzzle and thereby applies pressure to the housing 12 of cartridges 10 disclosed herein as each cartridge 10 passes through the choke. This significantly slows the forward momentum of the housing 12, but does not significantly slow the momentum of the projectile(s) 14 contained within the interior space 25. As such, the projectile(s) 14 and the cap 16 exit the housing 12 and the muzzle with approximately the same velocity as they passed through the bore. In this way, use of a choke can further increase the reliability and consistency with which projectiles are released from the cartridge housing 12 as the cartridge 10 exits the muzzle of the air gun barrel. This in turn provides a tighter shot pattern for increased accuracy and lethality.

In experiments, .50 caliber and .55 caliber cartridges 10 formed according to the present disclosure using ⅓ oz, ½ oz and ⅝ oz loads consistently produced muzzle velocities of over 1,000 feet per second when fired from commercially available large caliber air rifles and air shotguns. The shot patterns produced in such experiments mirrored the shot patterns produced by similar shot shells fired from traditional shotguns. The cartridges 10 disclosed herein have been successfully used to harvest turkey and waterfowl between 20 to 30 yards with a single shot. In all experiments, the inventor surprisingly discovered that, regardless of the air gun used, discharge of the cartridges 10 disclosed herein produced a very minor to negligible audible report.

Although embodiments of the present invention have been described in detail, it will be understood by those skilled in the art that various modifications can be made therein without departing from the spirit and scope of the invention as set forth in the appended claims. For example, it is contemplated that embodiments of the present invention could employ a fewer or a greater number of gas flow apertures 28 than the embodiment depicted in the drawings. It is also contemplated that that embodiments of the present invention could employ gas flow apertures 28 having a different configuration from that of the gas flow apertures 28 shown in the drawings.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An ammunition cartridge for an air gun, comprising:
- a housing defining an interior space, a rear portion and a forward portion;
- a partition disposed in the rear portion of the housing;
- a cap releasably engaged with the forward portion of the housing;
- at least one projectile received in the interior space between the partition and the cap; and
- at least one gas flow aperture extending through the partition
- wherein each of the housing, the partition, the cap, and the at least one projectile is propelled out of a muzzle of the air gun upon discharge of the air gun when the ammunition cartridge is received in a chamber of the air gun.

2. The ammunition cartridge of claim 1, wherein the cap is configured to retain the at least one projectile in the interior space until the forward portion of the housing is propelled out of the muzzle of the air gun.

3. The ammunition cartridge of claim 2, wherein:
- the forward portion of the housing includes an inner circumferential surface in which is defined a groove;
- the cap includes an outer circumferential surface from which a ridge protrudes radially outward; and
- the ridge engages the groove to retain the cap in the forward portion of the housing until the forward portion of the housing is propelled out of the muzzle of the air gun.

4. The ammunition cartridge of claim 2, wherein:
- the cap includes a disc portion having a circumferential edge, an annular skirt portion extending rearwardly from the circumferential edge, and a hollow space defined by the skirt portion against the disc portion; and
- the at least one projectile is at least partially received in the hollow space.

5. The ammunition cartridge of claim 1, wherein:
- the partition has a rear surface and a non-planar forward surface; and
- the at least one gas flow aperture extends from the rear surface to the forward surface.

6. The ammunition cartridge of claim 5, wherein the forward surface is concave.

7. The ammunition cartridge of claim 5, wherein:
- the partition includes a central portion and a peripheral portion surrounding the central portion; and
- the peripheral portion has a first thickness which is greater than a second thickness of the central portion.

8. The ammunition cartridge of claim 5, wherein:
- the rear portion of the housing ends in an annular rim; and
- the rear surface of the partition is recessed from the annular rim.

9. The ammunition cartridge of claim 1, wherein the partition is rigid and integrally formed with the rear portion of the housing.

10. The ammunition cartridge of claim 1, further comprising a band of knurling formed around an exterior surface of the housing.

11. The ammunition cartridge of claim 10, wherein the band of knurling is:
- a plurality of parallel, longitudinally extending ridges protruding from the exterior surface of the housing; or
- a plurality of parallel, longitudinally extending grooves defined in the exterior surface of the housing.

12. The ammunition cartridge of claim 1, further comprising a circumferential channel defined in an exterior circumferential surface of the housing, wherein the circumferential channel is closer to a rear end of the housing than a forward end of the housing.

13. An ammunition cartridge for an air gun, comprising:

a hollow cylindrical housing configured to be received in a chamber of the air gun, the housing including a rear portion, a forward portion having an open forward end and an inner circumferential surface in which is defined a groove, and an interior space;

a partition engaged with the rear portion of the body, the partition having a rear surface and a concave forward surface facing the interior space;

a cap received in and releasably engaged with the open forward end of the body, the cap having an outer circumferential surface from which a ridge protrudes radially outward;

at least one projectile received in the interior space between the concave forward surface of the partition and the cap; and a plurality of gas flow apertures defined through the partition to provide a flow path through which a pressurized gas provided by the air gun can enter the interior space from outside the housing;

wherein the ridge engages the groove to retain the cap in the open forward end of the housing until the forward portion of the housing is propelled out of a muzzle of the air gun by the pressurized gas.

14. An ammunition cartridge for an air gun, comprising:

a housing defining an interior space, the housing including a rear portion and a forward portion having an inner circumferential surface in which is defined a groove;

a partition disposed in the rear portion of the housing;

a cap releasably engaged with the forward portion of the housing, the cap including an outer circumferential surface from which a ridge protrudes radially outward;

at least one projectile received in the interior space between the partition and the cap; and at least one gas flow aperture extending through the partition;

wherein the ridge engages the groove to retain the cap in the forward portion of the housing until the forward portion of the housing is propelled out of a muzzle of the air gun upon discharge of the air gun when the ammunition cartridge is received in a chamber of the air gun.

15. The ammunition cartridge of claim 14, wherein:

each of the housing, the partition, the cap, and the at least one projectile is propelled out of the muzzle of the air gun upon discharge of the air gun when the ammunition cartridge is received in the chamber of the air gun; or the partition is secured to or integrally formed with the rear portion of the housing; or the partition has a concave forward surface; or the housing has a band of knurling formed around an exterior surface thereof.

16. An ammunition cartridge for an air gun, comprising:

a housing defining an interior space, the housing having a rear portion and a forward portion;

a partition disposed in the rear portion of the housing;

a cap releasably engaged with the forward portion of the housing;

at least one projectile received in the interior space between the partition and the cap;

at least one gas flow aperture extending through the partition; and a band of knurling formed around an exterior surface of the housing.

17. The ammunition cartridge of claim 16, wherein the band of knurling is:

a plurality of parallel, longitudinally extending ridges protruding from the exterior surface of the housing; or a plurality of parallel, longitudinally extending grooves defined in the exterior surface of the housing.

* * * * *